US005944335A

United States Patent [19]

Riepler

[11] Patent Number: 5,944,335

[45] Date of Patent: Aug. 31, 1999

[54] SLIDING DEVICE

[75] Inventor: Bernhard Riepler, Wagrain, Austria

[73] Assignee: Atomic Austria GmbH, Altenmarkt, Austria

[21] Appl. No.: 08/849,004

[22] PCT Filed: Aug. 7, 1996

[86] PCT No.: PCT/AT96/00142

§ 371 Date: May 5, 1997

§ 102(e) Date: May 5, 1997

[87] PCT Pub. No.: WO97/06864

PCT Pub. Date: Feb. 27, 1997

[30] Foreign Application Priority Data

Aug. 14, 1995 [AT] Austria ..... 1374/95

[51] Int. Cl.[6] ..... A63C 9/00

[52] U.S. Cl. ..... 280/602; 280/610

[58] Field of Search ..... 280/600, 602, 280/607, 609, 610, 617, 618, 633

[56] References Cited

U.S. PATENT DOCUMENTS

| | | | |
|---|---|---|---|
| 3,899,186 | 8/1975 | Matsuda . | |
| 5,333,889 | 8/1994 | Piegay et al. | 280/607 |
| 5,372,370 | 12/1994 | Rohrmoser . | |
| 5,584,496 | 12/1996 | Rohrmoser . | |
| 5,671,940 | 9/1997 | Abondance | 280/607 |
| 5,758,894 | 6/1998 | Maggiolo | 280/607 |

FOREIGN PATENT DOCUMENTS

| | | |
|---|---|---|
| 323614 | 7/1975 | Austria . |
| 387332 | 1/1989 | Austria . |
| 0414387 | 2/1991 | European Pat. Off. . |
| 0498053 | 8/1992 | European Pat. Off. . |
| 0607543 | 7/1994 | European Pat. Off. . |
| 2729085 | 7/1996 | France . |
| 3933717 | 4/1990 | Germany . |
| 4130110 | 4/1992 | Germany . |
| 4233631 | 4/1994 | Germany . |
| 91/16111 | 10/1991 | WIPO . |

*Primary Examiner*—Richard M. Camby
*Attorney, Agent, or Firm*—Abelman, Frayne & Schwab

[57] ABSTRACT

There is disclosed a sliding device, in particular a ski (1), having a carrying structure (1') as well as a core (11) at least substantially rigidly connected therewith, and a binding carrier arranged above the core (11) in the longitudinal middle portion of the sliding device and extending at least over the binding area in the longitudinal direction of the sliding device, the binding carrier being elastically supported relative to the carrying structure and the core (11) so as to avoid a transmission of oscillations and impacts from the ski (1) to the ski binding; to increase the stiffness and for an improved introduction of forces, the binding carrier is designed as a deflection-resistant shell carrier (2; 2'; 2") which also laterally embraces the core (11). (FIG. 4)

62 Claims, 3 Drawing Sheets

FIG. 1
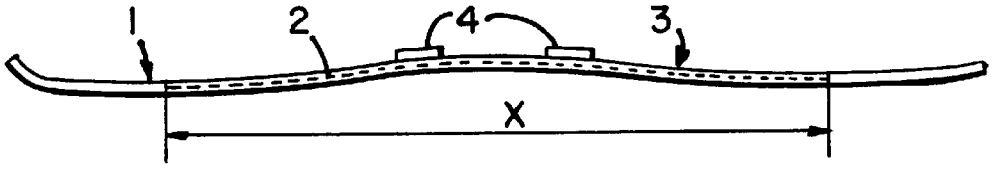
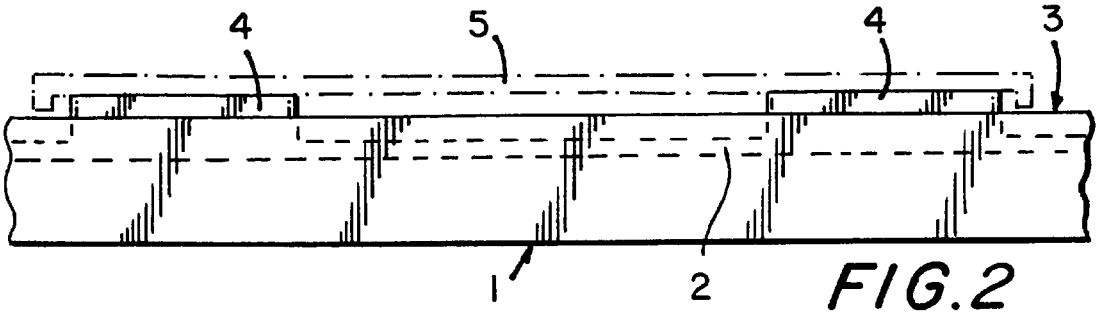
FIG. 2
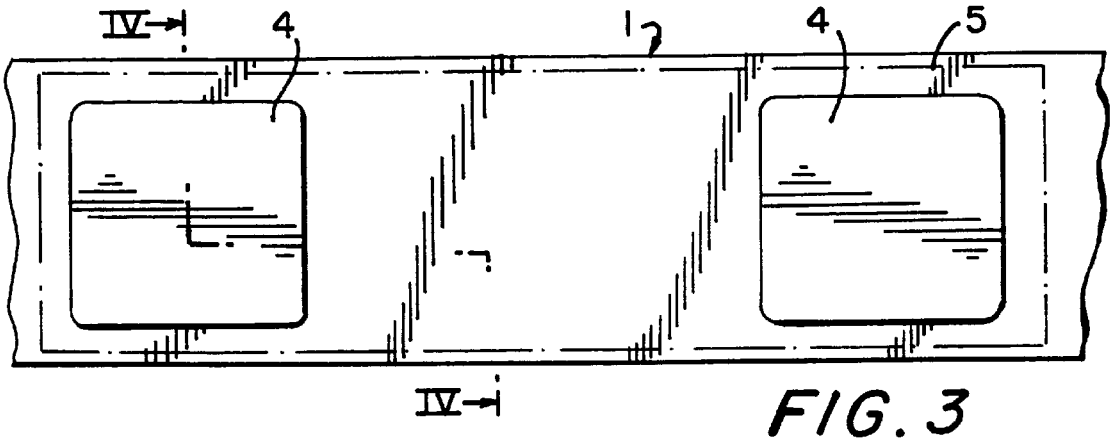
FIG. 3
FIG. 6
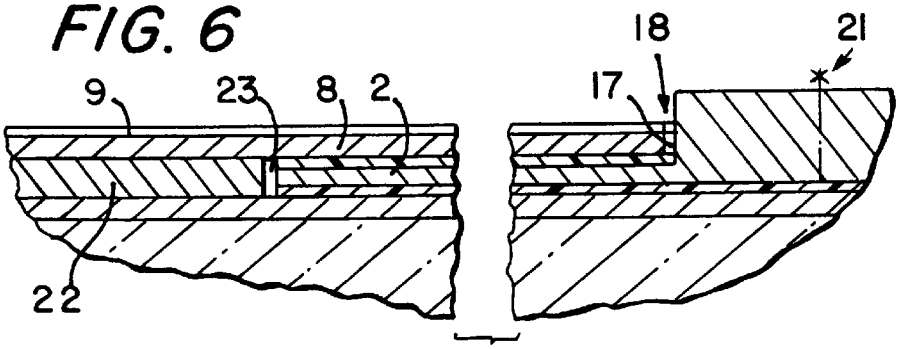

2/3

SLIDING DEVICE

The invention relates to a sliding device, in particular a ski, having a carrying structure as well as a core at least substantially rigidly connected therewith, and an elastically supported binding carrier arranged above the core in the longitudinal middle portion of the sliding device and extending at least over the binding area in the longitudinal direction of the sliding device.

A ski in a shell construction has, e.g., been known from DE 4 322 300 A1. In this ski, the spaces between the shell and the core are filled with an elastomer foam to improve its elastic properties and the damping, yet nevertheless, due to the connection of the shell with the lower strap, oscillations and impacts are transmitted to the ski binding.

A sliding device of the initially defined type in the form of a ski is furthermore known from DE-3 925 491 C2, wherein, as the binding carrier, a holding plate is arranged within a torsion box which is downwardly elastically supported on the core and is upwardly elastically supported on an aluminum plate. To fasten a ski binding, base plates are provided which rest on the holding plate via spacers and which are fastened by means of screws passing through the spacers and the holding plate; there, it is provided for the screws to penetrate into the core, whereby a rigid connection between the base plates—and thus also the ski binding—and the core is effected in a detrimental manner, and the elastic support of the holding plate is only insufficiently effective. On the other hand, the introduction of forces to the edges of the running faces via the upper holding plate is possible only insufficiently.

From AT 387 332 B, a ski having reinforcement inserts in the form of two sections angled in an obtuse angle is known, which sections overlap each other and are provided with a threaded bore in the attachment region for attachment of a binding. The superposed legs of the sections are both interconnected and connected to the ski core by gluing. Likewise, the laterally outwardly angled legs of the sections are connected with the core and the side faces formed by the core by gluing. Thus, there is a rigid connection between the core and the sections.

AT 323 614 B shows in a similar manner as AT 387 332 B, two reinforcement sections in the binding region which, together with a mounting plate for a binding, are screwed to the ski upper side. There, too, a rigid support of the binding is provided.

DE 39 33 717 A discloses a ski having several carrying and cover layers, an elastic bearing body being installed therebetween at least in the binding region. Yet, these layers and the elastic bearing body extend only over the width of the ski, only insufficient damping being enabled and the transmission of forces from the leg to the ski being impaired during skiing.

The invention has as its object to provide a sliding device of the initially defined type, in which a transmission of oscillations and impacts to the binding is avoided or at least dampened as much as possible, and in which an effective introduction of force for running on the edge is attained.

The sliding device according to the invention of the initially defined type is characterized in that the binding carrier is designed as a bending-resistant shell carrier which laterally embraces the core and is elastically supported. By these measures, the binding portions which are fastened to the shell carrier are advantageously mechanically uncoupled by the shell carrier from the remaining carrying structure, whereby a type of "integrated chassis" is obtained and whereby the transmission of oscillations is reliably avoided, yet the control function—with a corresponding length of the shell carrier—is not negatively affected. Above all, due to the shell shape of the binding carrier, i.e. a shape generally corresponding to an inverted "U", viewed in cross-section, it is not only possible to attain a comparatively higher stiffness of the binding carrier, but, in particular, also a direct introduction of force at the edges of the running faces is attainable via the legs of the shell carrier extending towards the same.

To enable positioning the support level of the boots above the upper side of the sliding device during production in the desired manner, as well as to increase the screw extraction resistance, it is advantageous that the shell carrier, at least in the fastening region of binding parts, has a thickness greater than that in the remaining regions of the shell carrier so as to accommodate fastening screws. The thickened portion may extend inwardly, so that a uniform, low structural height of the sliding device can be attained. Yet, to enable a simple connection of binding parts, such as front jaws, heel holders, binding carrier plates etc., with the shell carrier it has proven particularly advantageous if in the fastening region of the binding parts, the shell carrier is configured with at least one upwardly projecting pedestal which optionally projects through an opening in an upper side portion of the sliding device to beyond to ski upper side.

Therein, to ensure good movability of the shell carrier or its pedestal in the region of the opening, it is furthermore suitable if the or each pedestal, respectively, of the shell carrier is separated from the (respective) opening by a gap.

In view of the good movability and the elastic support of the shell carrier in the region of the (respective) opening it is furthermore advantageous if the or each pedestal of the shell carrier is elastically supported at the rim of the (respective) opening by an elastic layer applied in the gap.

For a simple and rapid mounting and removal of the construction parts of the binding, it is also particularly advantageous if the or each pedestal, respectively, comprises threaded blind bores to receive fastening screws for construction parts of the binding, e.g. for a binding carrier plate or for a guide rail.

In a preferred, structurally suitable embodiment, the shell carrier is elastically embedded between a shell, substantially U-shaped in cross-section, of the carrying structure, on the one hand, and the core, on the other hand; this embodiment thus has a shell-type construction of the sliding device, in particular of the ski, in which the elastically uncoupled shell-shaped binding carrier is contained. There, a particularly compact manner of construction can advantageously be achieved in that the shell carrier is arranged between an outer elastic layer and an inner elastic layer, the outer elastic layer being arranged within the shell and connected thereto, whereas the inner elastic layer is connected with the upper strap or core. There, the upper strap may be separate from the shell, or it may be arranged between shell carrier and core in this instance. The upper strap may as such also be directly integrated into the shell of the carrying structure, the shell carrier then being arranged between the shell (inclusive of upper strap) and core.

If the sliding device is constructed with an upper strap, a core and a lower strap as well as side faces, it has, on the other hand, proven advantageous if the shell carrier, which is embedded between an outer elastic layer and an inner elastic layer, is arranged with its upper base between an upper strap of the carrying structure and the core, its legs being externally covered by side faces. On the other hand, it is also suitable here if the shell carrier, which is embedded between an outer elastic layer and an inner elastic layer, is arranged with its upper base above an upper strap of the carrying structure, the shell carrier being externally covered by side faces and an upper layer. To simplify the assembly it is also advantageous if the inner elastic layer is arranged at a distance from the core, and the free cavity above and beside the core is filled with adhesive material which is also provided externally of the outer elastic layer and forms the side faces as well as an upper layer on which, optionally, the upper strap is provided.

In view of as rigid a connection as possible between components lying within and without the shell carrier, it has proven particularly suitable if the shell carrier has openings distributed, in particular at regular intervals, over the width and longitudinal directions and filled with adhesive material. In the instance of the construction manner with the upwardly arranged upper strap it is advantageous with respect to production if the adhesive material filling the cavity above and beside the core passes through the openings particularly provided in the legs of the shell carrier and thus forms an integral unit with the adhesive material provided externally of the outer elastic layer. In the instance of the shell construction manner, on the other hand, it is advantageous if the outer elastic layer is connected with the inner elastic layer in the rim region of the openings particularly provided in the region of the upper base of the shell carrier, the free cavity between the shell and the upper strap in the region of the openings being filled with adhesive material. With the—rigid—adhesive material a tight, compact connection is produced between the shell and the upper strap in an advantageous manner, without restricting the elastic support or movability of the shell-shaped binding carrier, i.e., the shell carrier, in the vertical and horizontal directions.

Another preferred embodiment is characterized in that the shell carrier surrounds a shell, of substantially U-shaped cross-section, of the carrying structure and is elastically supported; this embodiment thus has a conventional structure as such, lower strap—core—shell, yet the binding-shell carrier outwardly surrounds the shell and thus is elastically uncoupled, whereby also here the above-mentioned "integrated chassis" is obtained. Therein, it is structurally particularly advantageous if the shell carrier surrounds the shell via an elastic layer, the ends of the shell carrier and of the shell, viewed in cross-section, being inwardly angled and the elastic layer surrounding the ends of the shell carrier.

For the desired introduction of force into the edge regions it is furthermore suitable if the ends of the legs of the shell carrier are elastically supported on the rim regions of a lower strap. Furthermore, it is advantageous if the ends of the shell carrier as well as optionally the shell, viewed in cross-section, are angled outwardly.

With respect to the desired mechanical uncoupling of the shell carrier (inclusive of binding) from the remaining sliding device, it is furthermore particularly advantageous if the elastic support is formed by an elastic adhesive layer or by a rubber layer which is vulcanized thereon.

A generally sufficiently stiff configuration of the carrier which is easy to produce can be obtained if the shell carrier is an injection-moulded part.

Advantageously, the shell carrier is made of aluminum or a light metal alloy.

To attain the desired rigidity of the shell carrier, it is, however, also advantageous if the shell carrier is made of glass fiber reinforced plastic or of carbon fiber reinforced plastic.

To additionally increase the stiffness of the shell carrier, it is also suitable if the inner and/or the outer side of the shell carrier is structured, in particular in the longitudinal direction, by ribs, webs or flutes.

The invention will now be explained in more detail by way of the preferred exemplary embodiments illustrated in the drawings, to which, however, it is not to be restricted. Therein, FIG. 1 schematically illustrates a ski with built-in elastically uncoupled binding carrier;

FIG. 2 schematically illustrates the binding area of such a ski in side view;

FIG. 3 is a top view on the binding area of this ski according to FIG. 2;

FIG. 6 shows further details of the ski according to FIG. 4, in a longitudinal cross-section.

Figure 4:
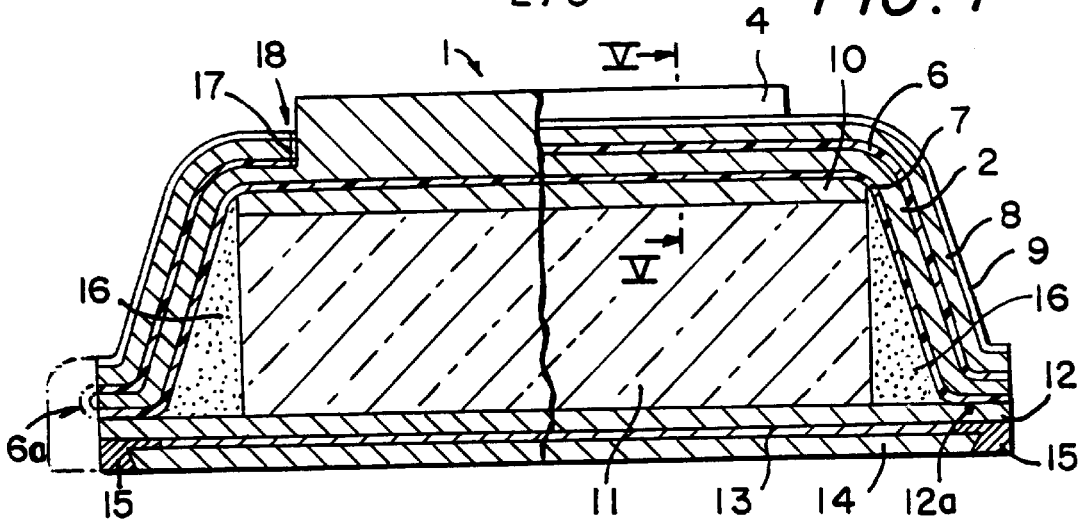
FIG. 4 shows a cross-section of a first embodiment according to line IV—IV of FIG. 3.

In FIGS. 1 to 3, a ski of laminated structure which in combination with FIG. 4, at least at present, is considered to be the particularly preferred embodiment, is generally denoted by 1, and in which a bending-resistant, shell-shaped binding carrier 2, subsequently termed shell carrier in short, is embedded, which shell carrier comprises two pedestals 4 projecting beyond the ski upper side 3 for attachment of the construction elements of the ski binding (not illustrated), in particular of a binding carrier plate 5, which is illustrated in FIGS. 2 and 3 in dot-and-dash lines. The wall thickness of the shell carrier 2 is e.g., approximately 1 to 1.5 mm, while its construction height in the region of the pedestal 4 is approximately 10 mm, which is sufficient with an insertion depth of 8 mm, e.g., for fastening screws. The construction length x of the shell carrier 2 is between 550 mm and approximately half the length of the ski, cf. FIG. 1, wherein the ends of the shell carrier 2 may extend as far as to the two contact regions of the ski 1 which is configured with a curvature in a conventional manner.

As can be seen from FIG. 2, the pedestals 4 are of rectangular, in particular square, shape, seen in top view. When using a binding carrier plate 5, a damping plate (not illustrated), in particular of a viscoelastic material, resting on the ski upper side 3 may be arranged between the pedestals 4 below the binding carrier plate 5. Furthermore, the binding carrier plate 5 may be provided with a guide rail (also not illustrated) for the construction parts of the ski binding.

In the embodiment of the ski 1 illustrated in FIG. 4, the shell carrier 2 is arranged between an upper or outer elastic layer 6 and a lower or inner elastic layer 7, the outer elastic layer 6 being arranged within a shell 8 of substantially U-shaped cross-section, which belongs the the carrying structure 1' of the ski 1 and is connected to the same; there, the shell 8 is constructed in a conventional manner, and it may also be multilayered and equipped with strengthening elements or reinforcements, which, however, has not been illustrated in the drawings for reasons of simplicity; furthermore, the shell 8 carries a cover layer 9 that may also be configured in several layers (e.g. design layer, transpartent protective layer).

The lower or inner elastic layer 7 is connected with an upper strap 10 which may also be multilayered, and the latter in turn is connected with the upper side of a core 11. The angle between the base of the U-shaped shell 8 and the legs thereof is preferably larger than 90°, and the ends of the legs are angled outwardly so as to extend in parallel to the horizontal. In this end portion, the inner elastic layer 7 is connected with a lower strap 12 arranged on the lower side of the core 11 so that the shell carrier 2 is elastically supported on the rim region 12*a* of the lower strap 12.

Via an intermediate layer 13, the lower strap 12 is connected with a running surface coating 14 which is provided with steel edges 15. The cavities 16 formed on either side of the core 11 as such are filled with a plastic foam, preferably an elastomer foam, yet the core 11 may also extend laterally as far as to the inner elastic layer 7.

As is apparent from the left half of the section of FIG. 4, openings 17 are provided in the region of the pedestal 4, in the parts of the upper side of the ski 1, i.e. in the shell 8 and in the cover layer 9, a gap 18 being formed between the pedestal 4 and the shell 8 or the cover layer 9, which gap enables a vertical movement of the pedestal 4 without any or with only little friction.

Figure 5:
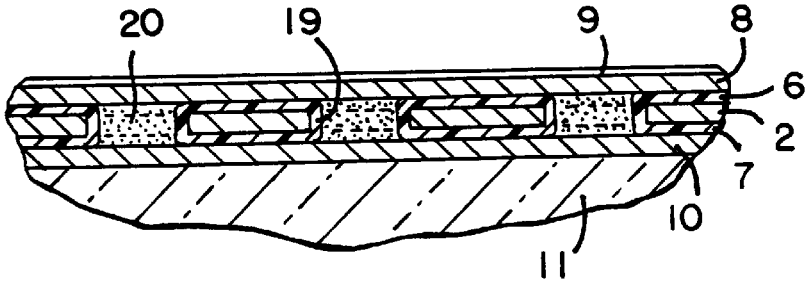
FIG. 5 shows a detail of a variant of the ski according to FIG. 4 in a longitudinal cross-section according to line V—V of FIG. 4.

FIG. 5 shows a longitudinal section of the ski 1 in the region beyond the pedestals 4, where the shell carrier 2 has openings 19, e.g. in the form of bores or long holes, the outer elastic layer 6 being connected with the inner elastic layer 7 in the rim region of the openings 19, and the free cavity between the shell 8 and the upper strap 10 in the region of the openings 19 being filled with adhesive material 20, e.g. epoxide resin, when the ski 1 is produced, so that a rigid connection is provided between the shell 8 and the upper strap 10, which, however, does not impair the elastic support or movability of the shell carrier 2 in the vertical and horizontal directions, on account of the connection of the elastic layers 6, 7 in the openings 19. The openings 19 are distributed at regular intervals over the upper side or base of the shell carrier 2 in the width and longitudinal directions.

The gap 18 formed between the pedestal 4 and the cover layer 9 or the shell 8, respectively, by the above-mentioned openings 17 can also be seen in the transition region illustrated in FIG. 6 in the ski longitudinal direction of the shell carrier 2 at the pedestal 4 and, e.g., on the leading end of the shell carrier 2 in the ski longitudinal direction, in the embodiment according to FIG. 4. A fastening screw in the pedestal 4 is schematically illustrated and denoted by 21. At the leading end (and, similarly, at the trailing end) of the shell carrier 2, a filling layer 22 is located between the upper strap 10 and the shell 8, the thickness of the filling layer corresponding to the sum of the material thicknesses of the two elastic layers 6 and 7 and the shell carrier 2, a free space 23 being provided on the front side between the filling layer 22 and the elastic layers 6, 7 as well as the shell carrier 2, which free space enables a longitudinal movement of the shell carrier 2. This space 23 may, of course, also be filled with elastic material.

The gap 18 illustrated in FIGS. 4 and 6 between the pedestal 4 and the cover layer 9 and the shell 8, respectively, may correspondingly be designed to have such a width that the upper elastic layer 6 can be led upwards as far as to the rim of the cover layer 9, thus filling the gap 18, so that the pedestal 4 will be elastically supported on all sides at the rim of the shell.

Figure 7:
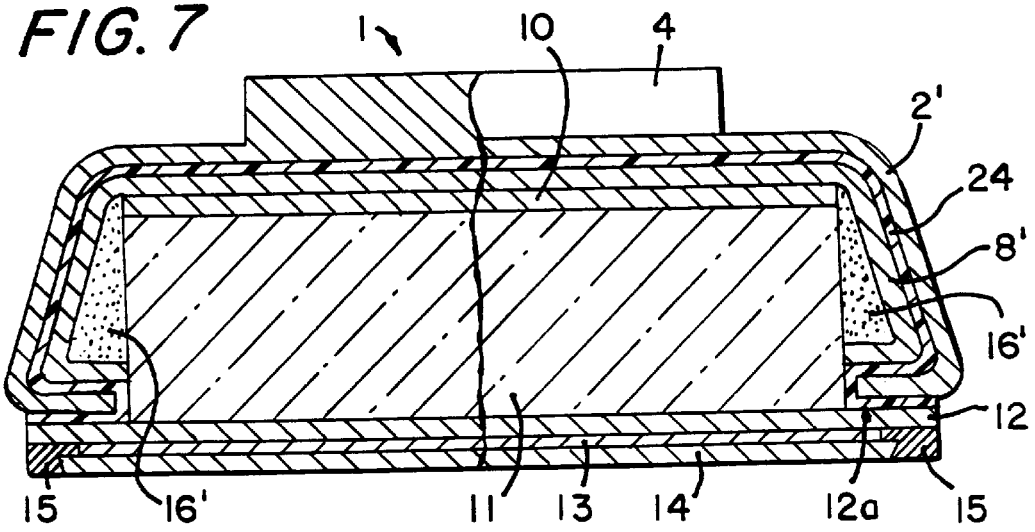
FIGS. 7 and 8 each show a cross-section of a further embodiment, the section being analogous to that of FIG. 4.

The embodiment of the ski 1 illustrated in FIG. 7 shows a shell carrier 2' closing, from without and via an elastic layer 24 arranged below or within the shell carrier 2', a shell 8' belonging to the carrying construction 1', the ends of the shell carrier 2' and of the shell 8', viewed in cross-section, being angled inwardly. The elastic layer 24 surrounds the inwardly angled ends of the shell carrier 2' such that the latter in turn is elastically supported relative to the rim regions 12*a* of the lower strap 12, the core 11, and the ends of the shell 8'. The cavities 16' which can be seen on either side of the core 11 in turn are filled with plastic foam or with the core material. The remaining assembly with lower strap 12, intermediate layer 13, running surface coating 14 and steel edges 15 is configured in the same manner as is illustrated in FIG. 4. A cover layer (not illustrated) is applied to the shell 8' only externally of the region of the shell carrier 2' (i.e. in the front and rear ski regions, cf. FIG. 1).

Figure 8:
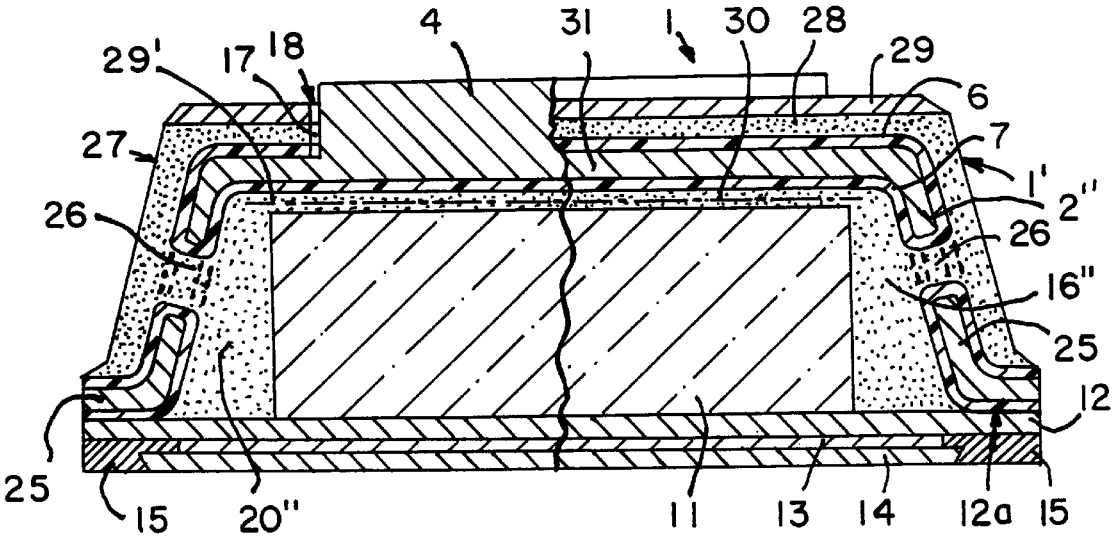

With the ski 1 illustrated in FIG. 8, the legs 25 of the shell carrier 2" have openings 26, e.g. in the form of bores or long holes, which are longitudinally spaced at regular intervals. The upper or outer elastic layer 6 is connected with the lower or inner elastic layer 7 in the rim region of the openings 26. The inner elastic layer 7 is arranged spaced from the core 11, and the free cavity above the core 11 formed thereby as well as the remaining free cavity 16" lateral of the core 11 are filled with adhesive material 20" which, penetrating through the openings 26 and reaching over the outer elastic layer 6, forms side faces 27 and an upper layer 28, on which an upper strap 29 belonging to the carrying structure 1' is attached, as well as a lower layer 30 above the core 11. In this instance, as the adhesive material 20", e.g. an elastically modified PU material is used which is hard or rigid in its final state and fulfills both an adhering function and the side face and filling material function. (Such a PU material is common as such and is already being used in the production of skis). The openings 17 again provided in the region of the pedestal 4, which form the gap 18, are formed in the outer elastic layer 6, in the upper layer 28 and in the upper strap 29, wherein the gap, as mentioned above, may be filled by the outer elastic layer 6.

As in the embodiment according to FIG. 4, the ends of the legs 25 of the shell carrier 2" are angled outwards and connected with the lower strap 12 via the inner elastic layer 7, so that the shell carrier 2" is elastically supported on the rim region 12*a* of the lower strap 12. Furthermore, similar to the illustration of FIG. 5, in the embodiment illustrated in FIG. 8 openings (not illustrated) may be provided in the upper portion of the shell carrier 2", through which the upper layer 28 may be connected with the lower layer 30. Vice versa, the openings 26 provided in the legs 25 of the shell carrier 24 according to FIG. 8 may also be provided in the embodiment according to FIG. 4.

Even though the invention has been explained in detail by way of preferred exemplary embodiments, it goes without saying that modifications and changes are possible, e.g. a single, elongate pedestal may be present for mounting the binding instead of two separate pedestals 4 shown in FIGS. 2 and 3. Also, as is only very schematically indicated at 6*a* in FIG. 4, in this embodiment the free, outwardly angled end of the shell carrier 2 may also be enclosed by elastic material, i.e. the outer elastic layer 6 and the inner elastic layer 7 are interconnected at 6*a*. In this instance, also the shell 8 may directly be connected with the lower strap 12—in a manner common per se, as is also indicated schematically—by dot-and-dash lines—in FIG. 4. Besides, such a conventional connection may also be provided in those regions of the ski where there is no shell carrier 2.

Contrary to what is shown in FIGS. 4 and 5, also the upper strap may be directly integrated into the shell, so that in this instance the stiff shell carrier 2 may rest directly on the core 11 via the inner elastic layer 7. In this instance, the otherwise preferably provided openings 19 in the shell carrier 2 (cf. FIG. 5) would, of course, be obviated.

Different from the embodiment illustrated in FIG. 8, it is furthermore possible to arrange an upper strap 29'—additionally to or instead of the upper strap 29 illustrated—in the PU filling and adhesive material 20" between the base 39 of the shell carrier 2" and the core 11, as is furthermore illustrated in dot-and-dash lines at 29' in FIG. 8.

The elastic layers 6, 7 and 24, respectively, may be formed by an elastic adhesive layer or by a rubber layer vulcanized on the shell carrier 2 or 2' or 2", respectively.

The shell carrier 2, 2' or 2", respectively, may be made of glass fiber reinforced plastic (GFK) or of a carbon fiber reinforced plastic. Alternatively, the shell carrier 2, 2' or 2", respectively, may be an injection-moulded part, e.g. of aluminum or of a light metal alloy. To increase the stiffness, the surface of the shell carrier 2, 2', 2" may be structured. Longitudinal flutes, ribs or webs having a depth or height of approximately 1 mm may, e.g., be provided on the upper and/or lower side of the shell carrier 2, 2', 2". The pedestals 4 may be provided with threaded pocket bores (not illustrated) to accommodate the fastening screws 19 for the structural parts of the ski binding, such as front jaws, heel holder or the binding carrier plate 5, optionally with guide rails for the binding parts.

The possible modes of construction described above by way of ski embodiments may furthermore be realized in sliding devices other than skis, in particular alpine skis, such as in firn gliders, in a monoski, but also in snowboards.

I claim:

1. A sliding device comprising a binding, a binding area, a carrying structure, a core at least substantially rigidly connected with said carrying structure, a bending-resistant shell carrier extending over only a portion of a longitudinal dimension of said sliding device and designed to carry said binding, said bending-resistant shell carrier having a thickness defined by a first surface and a second surface, at least a portion of said first surface being closer to an exterior of said sliding device than a corresponding portion of said second surface located across said thickness, at least a portion of said first surface being located interior to said sliding device, said bending-resistant shell carrier having a first region for fastening parts of said binding and a second region, said bending-resistant shell carrier being arranged above said core in a longitudinal middle portion of said sliding device so as to laterally embrace said core, said bending-resistant shell carrier extending at least over the binding area in the longitudinal direction of said sliding device, and means for elastically supporting said bending-resistant shell carrier with respect to said carrying structure.

2. A sliding device as set forth in claim 1, wherein said sliding device is a ski.

3. A sliding device as set forth in claim 1, wherein said bending-resistant shell carrier has a first thickness in said first region and a second thickness in said second region, said first thickness being greater than said second thickness so as to accommodate fastening screws therein.

4. A sliding device as set forth in claim 3, wherein said bending-resistant shell carrier includes at least one upwardly projecting pedestal in said fastening region of binding parts.

5. A sliding device as set forth in claim 4, wherein said sliding device has an upper side portion including at least one opening provided with a rim, said at least one upwardly projecting pedestal of said bending-resistant shell carrier projecting through said at least one opening in said upper side portion of said sliding device.

6. A sliding device as set forth in claim 5, wherein said at least one upwardly projecting pedestal of said bending-resistant shell carrier is spaced from the rim of said at least one opening by a gap.

7. A sliding device as set forth in claim 6, further comprising an elastic layer applied in said gap, the at least one pedestal of said bending-resistant shell carrier being elastically supported at the rim of said at least one associated opening by said elastic layer.

8. A sliding device as set forth in claim 5, wherein said at least one pedestal of said bending-resistant shell carrier includes threaded blind bores to receive fastening screws for construction parts of a binding.

9. A sliding device as set forth in claim 1, wherein said carrying structure includes a shell of substantially U-shaped cross-section, said bending-resistant shell carrier being elastically embedded between said substantially U-shaped shell of said carrying structure and said core.

10. A sliding device as set forth in claim 9, wherein a first elastic layer is provided within and connected to said substantially U-shaped shell, and wherein a second elastic layer is provided between said bending-resistant shell carrier and said core, said first elastic layer constituting an outer elastic layer for said bending-resistant shell carrier and said second elastic layer constituting an inner elastic layer for said bending-resistant shell carrier arranged therebetween.

11. A sliding device as set forth in claim 9, wherein said carrying structure includes an upper strap, and wherein a first elastic layer is provided within and connected to said substantially U-shaped shell, and wherein a second elastic layer is connected with said upper strap, said first elastic layer constituting an outer elastic layer for said bending-resistant shell carrier and said second elastic layer constituting an inner elastic layer for said bending-resistant shell carrier arranged therebetween.

12. A sliding device as set forth in claim 1, wherein said carrying structure includes an upper strap and side faces, and wherein said bending-resistant shell carrier has an upper base and legs, said bending-resistant shell carrier being embedded between an outer elastic layer and an inner elastic layer and said upper base of said bending-resistant shell carrier being arranged between said upper strap of said carrying structure and said core, and said legs of said bending-resistant shell carrier being externally covered by said side faces of said carrying structure.

13. A sliding device as set forth in claim 1, wherein said carrying structure includes an upper strap, side faces and an upper layer, and wherein said bending-resistant shell carrier includes a base and is embedded between an outer elastic layer and an inner elastic layer, said upper base of said bending-resistant shell carrier being arranged above said upper strap of said carrying structure, and said bending-resistant shell carrier being externally covered by said side faces and said upper layer of said carrying structure.

14. A sliding device as set forth in claim 12, wherein said inner elastic layer is arranged at a distance from said core so as to form a free cavity above and beside said core, and further comprising adhesive material filling said free cavity and also being provided externally of said outer elastic layer so as to form said side faces of said carrying structure.

15. A sliding device as set forth in claim 13, wherein said inner elastic layer is arranged at a distance from said core so as to form a free cavity above and beside said core, and further comprising adhesive material filling said free cavity and also being provided externally of said outer elastic layer so as to form said side faces and said upper layer of said carrying structure.

16. A sliding device as set forth in claim 1, wherein said bending-resistant shell carrier is provided with further openings distributed longitudinally and transversely over said bending-resistant shell carrier and filled with adhesive material.

17. A sliding device as set forth in claim 16, wherein said further openings are provided at regular intervals.

18. A sliding device as set forth in claim 16, wherein said bending-resistant shell carrier is provided with legs including further openings, said adhesive material filling said cavity above and beside said core and passing through said further openings provided in said legs so as to form an integral unit with said adhesive material provided externally of said outer elastic layer.

19. A sliding device as set forth in claim 10, wherein said carrying structure includes an upper strap and wherein said bending-resistant shell carrier has an upper base above said upper strap and is provided with further openings distributed in the region of said upper base, said openings having rim regions and being filled with adhesive material, and wherein said outer elastic layer is connected with said inner elastic layer in said rim region of said openings, said adhesive material connecting said U-shaped shell and said upper strap through said further openings.

20. A sliding device as set forth in claim 1, wherein said carrying structure includes a shell of substantially U-shaped cross-section, said bending-resistant shell carrier surrounding said U-shaped shell.

21. A sliding device as set forth in claim 20, wherein said U-shaped shell and said bending resistant shell carrier each have inwardly angled end portions, viewed in cross-section, and wherein said bending resistant shell carrier surrounds said U-shaped shell via an elastic layer surrounding the angled end portions of said bending-resistant shell carrier.

22. A sliding device as set forth in claim 1, wherein said carrying structure includes a lower strap with rim regions and wherein said bending-resistant shell carrier includes legs having ends elastically supported on said rim regions of said lower strap of said carrying structure.

23. A sliding device as set forth in claim 1, wherein said bending-resistant shell carrier includes ends, said ends being angled outwardly in cross-sectional view.

24. A sliding device as set forth in claim 23, wherein said carrying structure includes a shell of substantially U-shaped cross-section having ends angled outwardly in cross-sectional view.

25. A sliding device as set forth in claim 1, wherein said means for elastically supporting said bending-resistant shell carrier is an elastic adhesive layer.

26. A sliding device as set forth in claim 1, wherein said means for elastically supporting said bending-resistant shell carrier is a rubber layer vulcanized on said bending-resistant shell carrier.

27. A sliding device as set forth in claim 1, wherein said bending-resistant shell carrier is an injection-moulded part.

28. A sliding device as set forth in claim 1, wherein said bending-resistant shell carrier is made of a material selected from the group consisting of aluminum, a light metal alloy, glass fiber reinforced plastic and carbon fiber reinforced plastic.

29. A sliding device as set forth in claim 1, wherein said bending-resistant shell carrier has an inner side and an outer side and at least one of said inner and said outer side is structured.

30. A sliding device as set forth in claim 29, wherein said structuring is provided longitudinally.

31. A sliding device as set forth in claim 29, wherein said structuring is formed by ribs, webs or flutes.

32. A sliding device comprising a binding area, a carrying structure, a core at least substantially rigidly connected with said carrying structure, a binding carrier designed as a bending-resistant shell carrier extending over only a portion of a longitudinal dimension of said sliding device, said bending-resistant shell carier having a thickness defined by a first closer to an exterior of said sliding device than a corresponding poriton of said second surface located across said thickness, at least a portion of said first surface being located interior to said sliding device, said bending-resistant shell carrier having a first region for fastening parts of a binding and a second region, said bending-resistant shell carrier being arranged above said core in a longitudinal middle portion of said sliding device so as to laterally embrace said core, said bending-resistant shell carrier extending at least over the binding area in the longitudinal direction of said sliding device, and means for elastically supporting said bending-resistant shell carrier with respect to said carrying structure.

33. A sliding device as set forth in claim 32, wherein said sliding device is a ski.

34. A sliding device as set forth in claim 32, wherein said bending-resistant shell carrier has a first thickness in said first region and a second thickness in said second region, said first thickness being greater than said second thickness so as to accommodate fastening screws therein.

35. A sliding device as set forth in claim 34, wherein said bending-resistant shell carrier includes at least one upwardly projecting pedestal in said fastening region of binding parts.

36. A sliding device as set forth in claim 35, wherein said sliding device has an upper side portion including at least one opening provided with a rim, said at least one upwardly projecting pedestal of said bending-resistant shell carrier projecting through said at least one opening in said upper side portion of said sliding device.

37. A sliding device as set forth in claim 36, wherein said at least one upwardly projecting pedestal of said bending-resistant shell carrier is spaced from the rim of said at least one opening by a gap.

38. A sliding device as set forth in claim 27, further comprising an elastic layer applied in said gap, the at least one pedestal of said bending-resistant shell carrier being elastically supported at the rim of said at least one associated opening by said elastic layer.

39. A sliding device as set forth in claim 36, wherein said at least one pedestal of said bending-resistant shell carrier includes threaded blind bores to receive fastening screws for construction parts of a binding.

40. A sliding device as set forth in claims 32, wherein said carrying structure includes a shell of substantially U-shaped cross-section, said bending-resistant shell carrier being elastically embedded between said substantially U-shaped shell of said carrying structure and said core.

41. A sliding device as set forth in claim 40, wherein a first elastic layer is provided within and connected to said substantially U-shaped shell, and wherein a second elastic layer is provided between said bending-resistant shell carrier and said core, said first elastic layer constituting an outer elastic layer for said bending-resistant shell carrier and said second elastic layer constituting an inner elastic layer for said bending-resistant shell carrier arranged therebetween.

42. A sliding device as set forthin claim 40, wherein said carrying structure includes an upper scrap, and wherein a first elastic layer is provided within and connected to said substantially U-shaped shell, and wherein a second elastic layer is connected with said upper strap, said first elastic layer constituting an outer elastic layer for said bending-resistant shell carrier and said second elastic layer constituting an inner elastic layer for said bending-resistant shell carrier arranged therebetween.

43. A sliding device as set forthin claim 32, wherein said carrying stucture includes an upper strap and side faces, and wherein said bending-resistant shell carrier has an upper base and legs, said bending-resistant shell carrier being embedded between an outer elastic layer and an inner elastic layer and said upper base of said bending-resistant shell carrier being arranged between said upper strap of said carrying structure and said core, and said legs of said bending-resistant shell carrier being externally covered by said faces of said carrying structure.

44. A sliding device as set forthin claim 32, wherein said carrying structure includes an upper strap, side faces and an upper layer, and wherein said bending-resistant shell carrier includes a base and is embedded between an outer elastic layer and an inner elastic layer, said upper base of said bending-resistant shell carrier being arranged above said upper strap of said carrying structure, and said bending-resistant shell carrier being externally covered by said side faces and said upper layer of said carrying structure.

45. A sliding device set forth in claim 43, wherein said inner elastic layer is arranged at a distance from said core so as to form a free cavity above and beside said core, and further comprising adhesive material filling said free cavity and also being provided externally of said outer elastic layer so as to form said side faces of said carrying structure.

46. A sliding device as set forth in claim 44, wherein said inner elastic layer is arranged at a distance from said core so as to form a free cavity above and beside said core, and further comprising adhesive material filling said free cavity and also being provided externally of said outer elastic layer so as to form said side faces and said upper layer of said carrying structure.

47. A sliding device as set forth in claim 32, wherein said bending-resistant shell carrier is provided with further openings distributed longitudinally and transversely over said bending-resistant shell carrier and filled with adhesive material.

48. A sliding device as set forth in claim 47, wherein said further openings are provided at regular intervals.

49. A sliding device as set forth in claim 45, wherein said bending-resistant shell carrier is provided with legs including further openings, said adhesive material filling said cavity above and beside said core and passing through said further openings provided in said legs so as to form an integral unit with said adhesive material provided externally of said outer elasitc layer.

50. A sliding device as set forth in claim 41, wherein said carrying structure includes an upper strap and wherein said bending-resistant shell carrier has an upper base above said upper strap and is provided with further openings distributed in the region of said upper base, said openings having rim regions and being filled with adhesive material, and wherein said outer elastic layer is connected with said inner elastic layer in said rim region of said openings, said adhesive material connecting said U-shaped shell and said upper strap through said further openings.

51. A sliding device as set forth in claim 32, wherein said carrying structure includes a shell of substantially U-shaped cross-section, said bending-resistant shell carrier surrounding said U-shaped shell.

52. A sliding device as set forth in claim 51, wherein said U-shaped shell and said bending resistant shell carrier each have inwardly angled end portions, viewed in cross-section, and wherein said bending resistant shell carrier surrounds said U-shaped shell via an elastic layer surrounding the angled end portions of said bending-resistant shell carrier.

53. A sliding device as set forth in claim 32, said carrying structure includes a lower strap with rim regions sand wherein said bending-resistant shell carrier includes legs having ends elastically supported on said rim regions of said lower strap of said carrying structure.

54. A sliding device as set forth in claim 32, wherein said bending-resistant shell carrier includes ends, said ends being angled outwardly in cross-sectional view.

55. A sliding device as set forth in claim 54, wherein said carrying structure includes a shell of substantially U-shaped cross-sectional having ends angled outwardly in cross-sectional view.

56. A sliding device as set forth in claim 32, wherein said means for elastically supporting said bending-resistant shell carrier is an elastic adhesive layer.

57. A sliding device as set forth in claim 32, wherein said means for elastically supporting said bending-resistant shell carrier is a rubber layer vulcanized on said bending-resistant shell carrier.

58. A sliding device as set forth in claim 32, wherein said bending-resistant shell carrier is an injection-moulded part.

59. A sliding device as set forth in claim 32, wherein said bending-resistant shell carrier is made of a material selected from the group consisting of aluminum, a light metal alloy, glass fiber reinforced plastic and carbon fiber reinforced plastic.

60. A sliding device as set forth in claim 32, wherein said bending-resistant shell carrier has an inner side and an outer side and at least one of said inner and said outer side is structured.

61. A sliding device as set forth in claim 60, wherein said structuring is provided longitudinally.

62. A sliding device as set forth in claim 60, wherein said structuring is formed by ribs, webs or flutes.

* * * * *